US005476390A

United States Patent [19]

Taguchi et al.

[11] Patent Number: 5,476,390

[45] Date of Patent: Dec. 19, 1995

[54] LEVER-COUPLING TYPE CONNECTOR

[75] Inventors: Naoto Taguchi; Yuji Hatagishi; Toshiaki Okabe, all of Shizuoka, Japan

[73] Assignee: Yazaki Corporation, Tokyo, Japan

[21] Appl. No.: 209,732

[22] Filed: Mar. 14, 1994

[30] Foreign Application Priority Data

Mar. 17, 1993 [JP] Japan ..... 5-057155

[51] Int. Cl.[6] ..... H01R 13/62

[52] U.S. Cl. ..... 439/157; 439/155

[58] Field of Search ..... 439/152–160, 439/372, 341

[56] References Cited

U.S. PATENT DOCUMENTS

| | | | |
|---|---|---|---|
| 5,135,408 | 8/1992 | Suzuki | 439/157 |
| 5,135,410 | 8/1992 | Kawase | 439/157 |
| 5,174,785 | 12/1992 | Endo et al. | 439/157 |
| 5,230,635 | 7/1993 | Takenouchi et al. . | |
| 5,263,871 | 11/1993 | Sano | 439/157 |
| 5,279,506 | 1/1994 | Kawase et al. | 439/157 |

FOREIGN PATENT DOCUMENTS 4-106876 9/1992 Japan .

*Primary Examiner*—David L. Pirlot

*Attorney, Agent, or Firm*—Armstrong, Westerman, Hattori, McLeland & Naughton

[57] ABSTRACT

A lever-coupled connector includes a male connector having latch pins, a female connector having pin guiding recesses into which the latch pins are to be received, a fitting lever of synthetic resin rotatably attached to the female connector, the lever having driving cam grooves for the latch pins and initial position holding protrusions to be engaged with the female connectors. In a state where the initial position holding protrusions are engaged with the connector to prevent the lever from being rotated, when the male connector is inserted into the female connector, the latch pins release the protrusions from engagement with the female connector to permit the fitting lever to be rotatable. Thus, the initial position of the lever rotatably attached to the connector can be assured without using any spring.

5 Claims, 7 Drawing Sheets

LEVER-COUPLING TYPE CONNECTOR

BACKGROUND OF THE INVENTION

1. Field of the Invention

The present invention relates to a lever-coupling type connector which is used for connection of wire harnesses for vehicles and in which fitting and releasing of a pair of female and male connectors are carried out by rotation of a lever.

2. Description of the Prior Art

In FIG. 14, symbol denotes a female connector and symbol "b" denotes a male connector. The female connector "a" is provided with a lever "d" for operating fitting or releasing of the male connector "b". The lever "d" is provided so as to be rotatable. In operation, when the lever "d" is rotated, its cam grooves drive the fitting or releasing of the male connector "b" through latch pins "f", "f".

At the initial time when the male connector "b" is coupled to the female connector a, the pin-to-be-driven "f", "f" must be received by the opening ends "el", "el" of the cam groove "e", "e" of the lever "d". In this case, the lever d must be held at an initial position so that the opening ends "el", "el" of the cam groove "e" can always receive the latch pins "f", "f". To this end, springs g, g are used.

Such a structure increases cost for springs and their mounting. The mounting workability is also poor.

SUMMARY OF THE INVENTION

The present invention has been accomplished in view of the above circumstances.

An object of the present invention is to provide a connector having a lever which can be held at an initial position connectable to a partner connector without using conventional springs.

In accordance with one aspect of the present invention, there is provided a lever-coupled connector comprising: a male connector having latch pins; a female connector having pin guiding recesses into which the latch pins are to be received; and a lever of synthetic resin rotatably attached to the female connector, said lever having driving cam grooves for said pins-to-be-driven and initial position holding protrusions to be engaged with the female connectors, whereby in a state where the initial position holding protrusions are engaged with said female connector to prevent said lever from being rotated, when said male connector is inserted into the female connector, the latch pins release said protrusions from said female connector to permit said lever to be rotatable.

In operation, in the state where an initial position holding protrusion holds the initial position of a lever, when a male connector is inserted into a female connector, latch pins drives the lever or a flexible arm to displace the initial position holding protrusions, thereby canceling the restriction for the rotation of the lever.

In accordance with the present invention, the lever for fitting and releasing female and male connectors can be surely held in its initial position without using springs which have been required and automatically released from the initial position when a cooperating connector part is inserted.

The above and other objects and features of the present invention will be more apparent from the following description taken in conjunction with the accompanying drawings.

DESCRIPTION OF THE PREFERRED EMBODIMENTS

Embodiment 1

Figure 1:
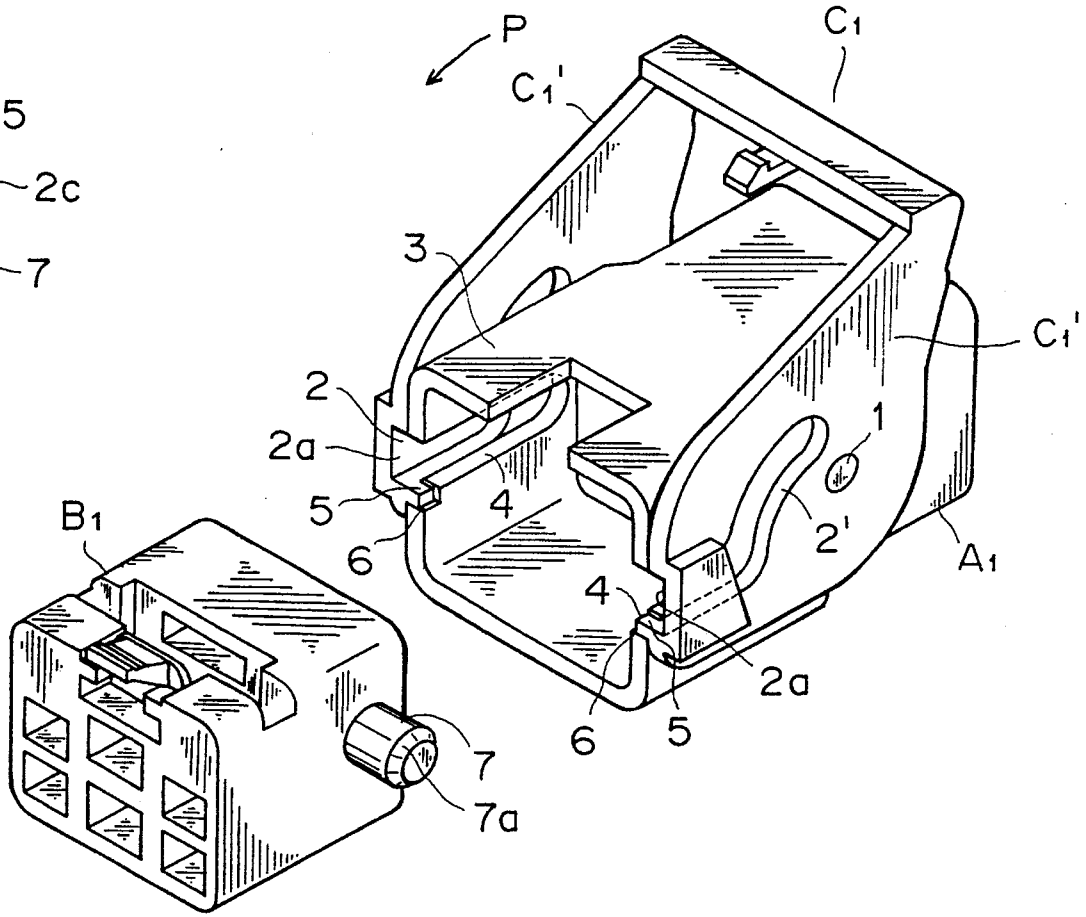
FIG. 1 is a perspective view of the separated state of female and male connectors according to an embodiment of the present invention.

In FIG. 1, symbol A1 denotes a female connector and symbol B1 denotes a male connector. They are made of synthetic resin, respectively, and incorporate metal fittings (not shown). The female connector A1 is provided with a fitting/releasing lever C1 for the male connector B1. The fitting/releasing lever C1 is provided so as to be rotatable around a supporting pivot shaft. The lever C1 includes driving cam grooves 2, 2. The cover 3 of the female connector A1 has pin-guiding recesses 4, 4.

The lever C1 which is integrally made of synthetic resin is provided with initial position holding protrusions 5, 5 on the inner faces of its front end. The protrusions 5, 5 are engaged with recess engagement portions 6, 6 formed at the front ends of the recesses 4, 4 so that the rotation of the lever C1 in the direction of an arrow P is prevented to assure the initial position of the lever C1. Incidentally, the male connector B1 includes latch pins 7, 7 protruding from its both sides.

Figure 2:
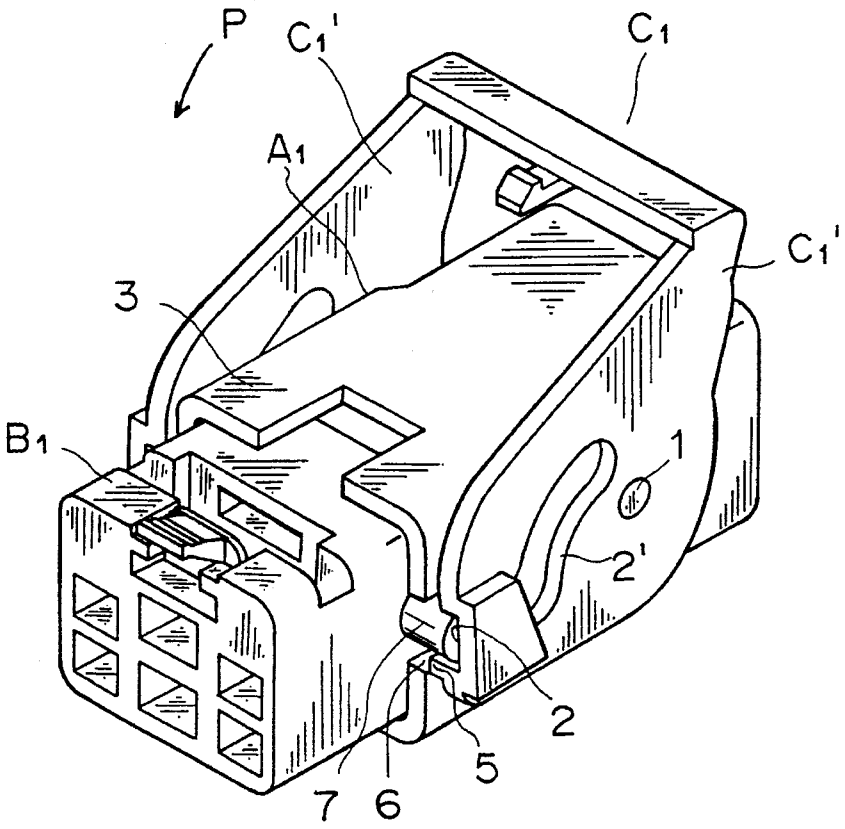
FIG. 2 is a perspective view of the provisional coupled state of female and male connectors shown in FIG. 1.

In such a structure, when the male connector B1 is fit into the cover 3 of the female connector A1, the latch pins 7, 7 extend into the pin-guiding recesses 4 and also into the driving cam grooves 2, 2 while its tapered hitting portions *7a*, *7a* hit on the front ends of the bottom walls *2a*, *2a* of the driving cam grooves 2, 2' to spread cam plates C1', C1' outwardly or sideward. When the cam plate portions C1' and C1' are spread sideward, the protrusions 5, 5 are released from the engagement portions 6, 6. Thus, the lever C1 becomes rotatable in the direction of an arrow P (FIG. 2).

When the lever C1 rotates, the male connector B1 is pulled into the female connector A1 through the latch pins 7, 7. When the latch pins 7, 7 reach the portions 2', 2' having no bottom walls, the cam portions C1' and C1' are restored to their initial lateral position.

In such a structure, in releasing the female and male connectors A1 and B1 from each other, when the latch pins 7, 7 are engaged with the portions of the driving cam grooves 2, 2 having the bottom walls 2*a*, 2*a*, starting from the portions 2', 2' of the grooves 2, 2, by the reverse-direction operation of the lever C1, the cam plate portions C1' and C1' are spread laterally sideward again.

In this embodiment, the protrusions 5, 5 for holding the initial position of the lever are provided on the lever so that they engage the engagement portions 6, 6 of the female connector. But, the protrusions may be provided on female connector so that they are engaged with the engagement portions on the lever.

Embodiment 2

Figure 3:
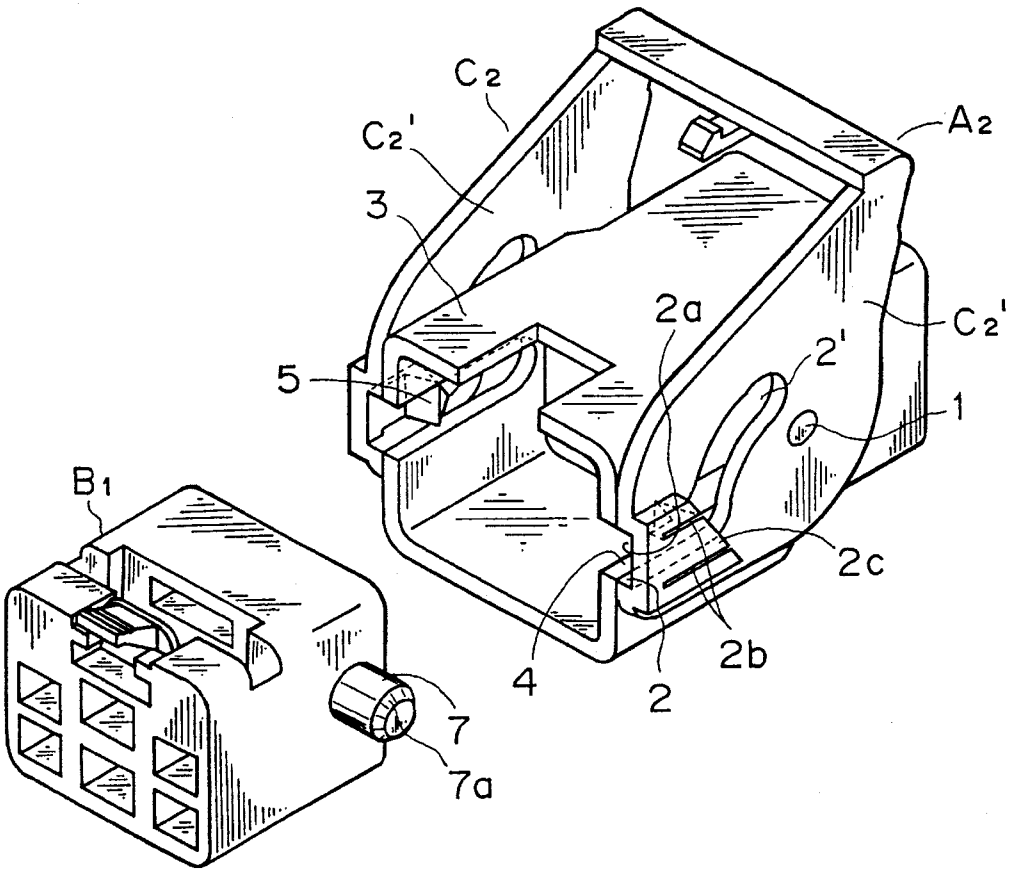
FIG. 3 is a perspective view of the separated state of female and male connectors according to another embodiment of the present invention.

In the embodiment of FIG. 3, a female connector A2 includes pin-guiding recesses 4, 4 formed in its cover 3. The female connector A2 is coupled with a lever C2 provided to be rotatable around its supporting shaft 1. Each of the cam plate portions C2', C2' of the lever C2 has a driving cam groove 2 having a bottom wall 2*a* and another driving cam groove 2' having no bottom wall successive thereto.

Figure 5:
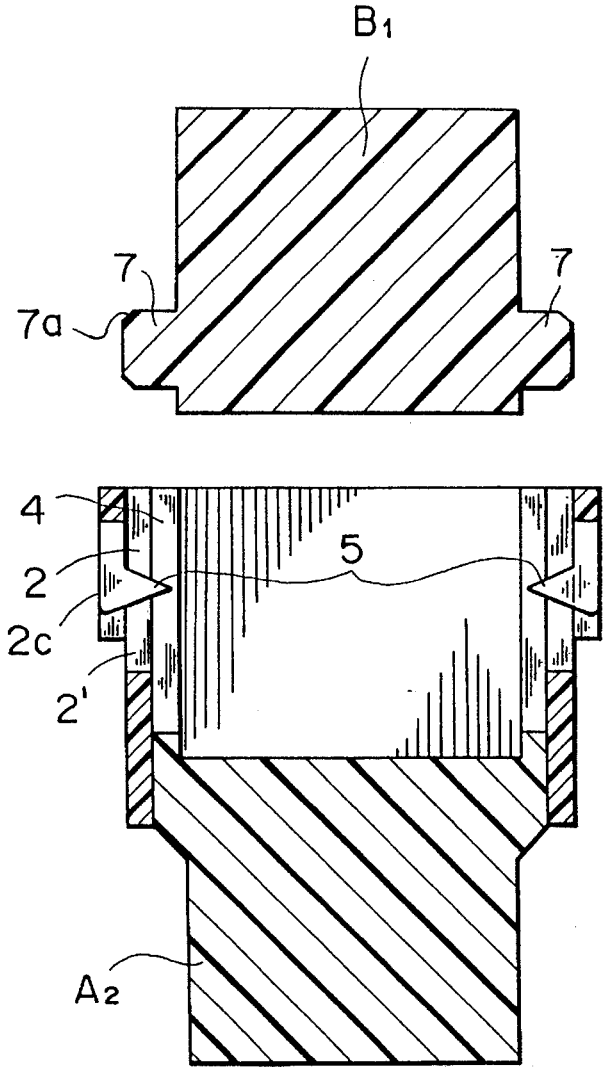
FIG. 5 is a sectional view of the state shown in FIG. 3.

The bottom wall of each driving cam groove 2 has a resilient piece 2*c* formed by a pair of slits 2*b*, 2*b*. The resilient piece 2*c* is provided with an initial position holding protrusion 5 protruding at the inner face of its rear free end. The initial position holding protrusion 5 is engaged with the pin-guiding recess 4 (FIG. 5).

Figure 6:
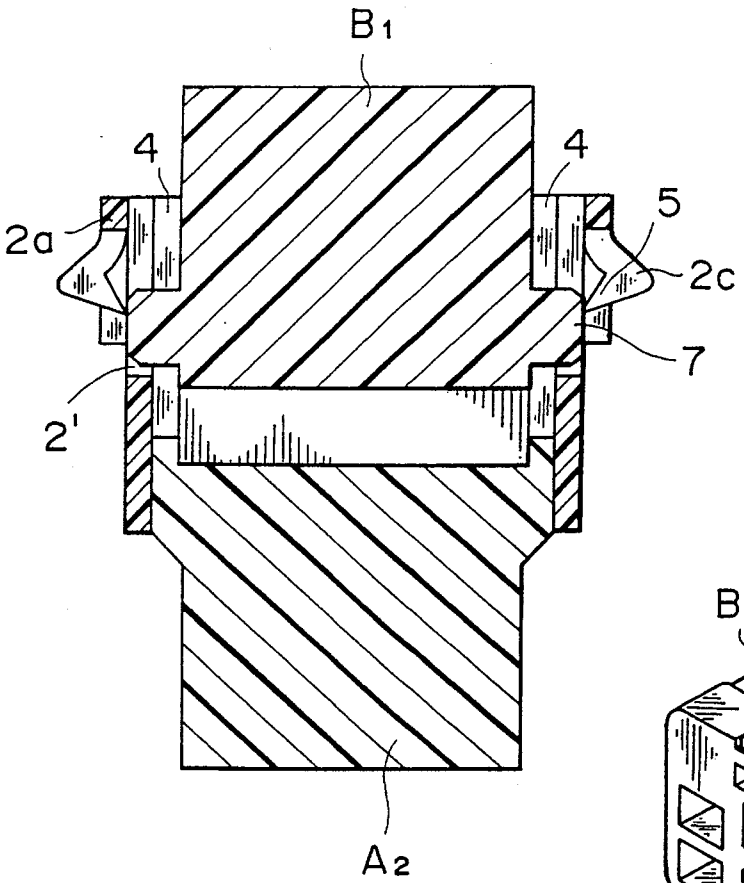
FIG. 6 is a sectional view of the state shown in FIG. 4.
Figure 4:
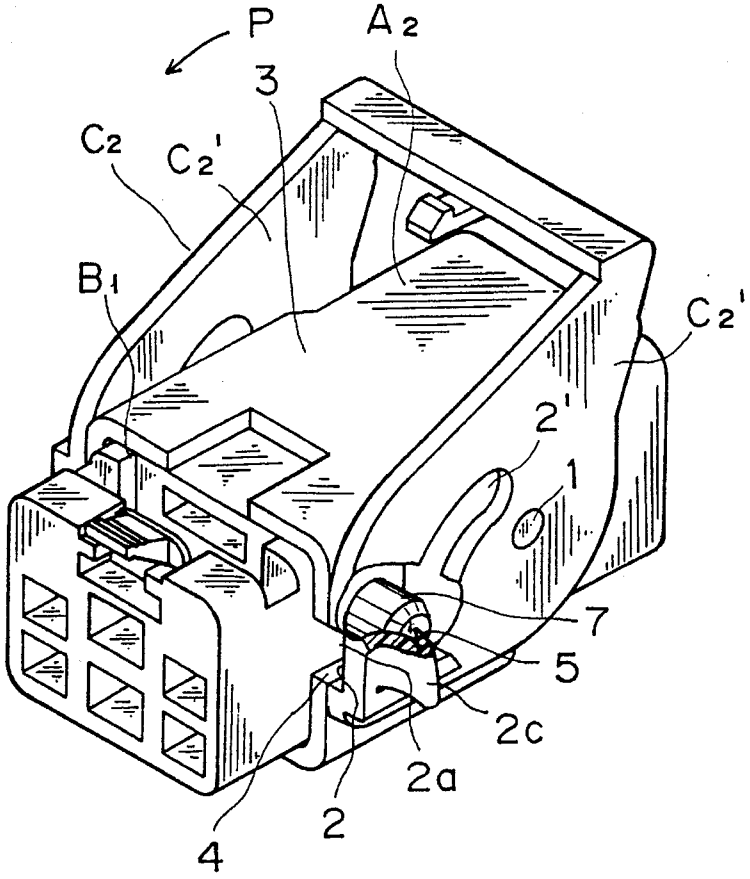
FIG. 4 is a perspective view of the provisional coupled state of female and male connectors shown in FIG. 3.

In this state, when the male connector B1 is inserted into the female connector A2, the latch pins 7, 7 hit on the initial position holding protrusions 5, 5 to spread the resilient pieces 2*c*, 2*c* outwardly or sidewardly. Then, since the initial position holding protrusions 5, 5 are released from the pin guiding recesses 4, 4, the lever C2 becomes rotatable in the direction of an arrow P (FIGS. 4, 6 and 7).

Figure 7:
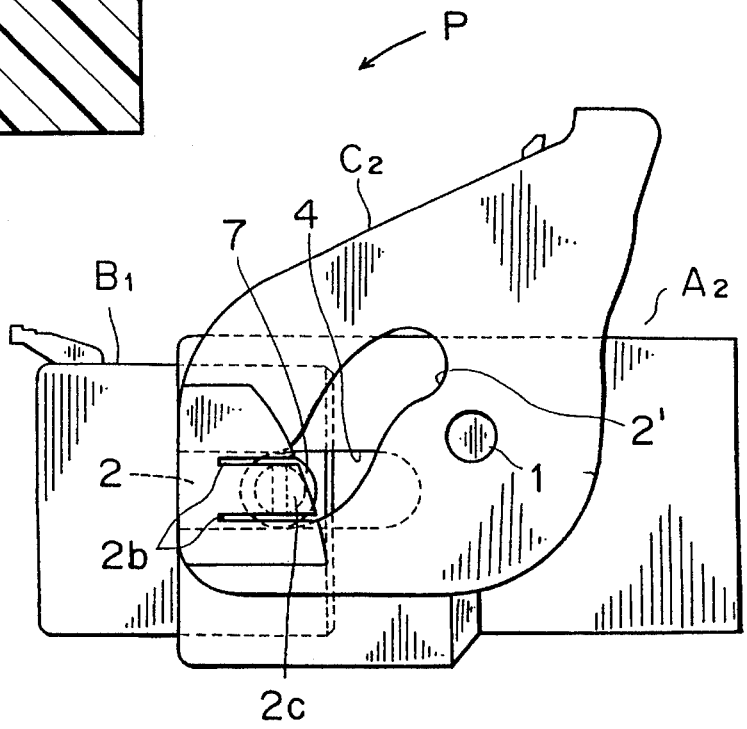
FIG. 7 is a side view of the state shown in FIG. 4.
Figure 8:
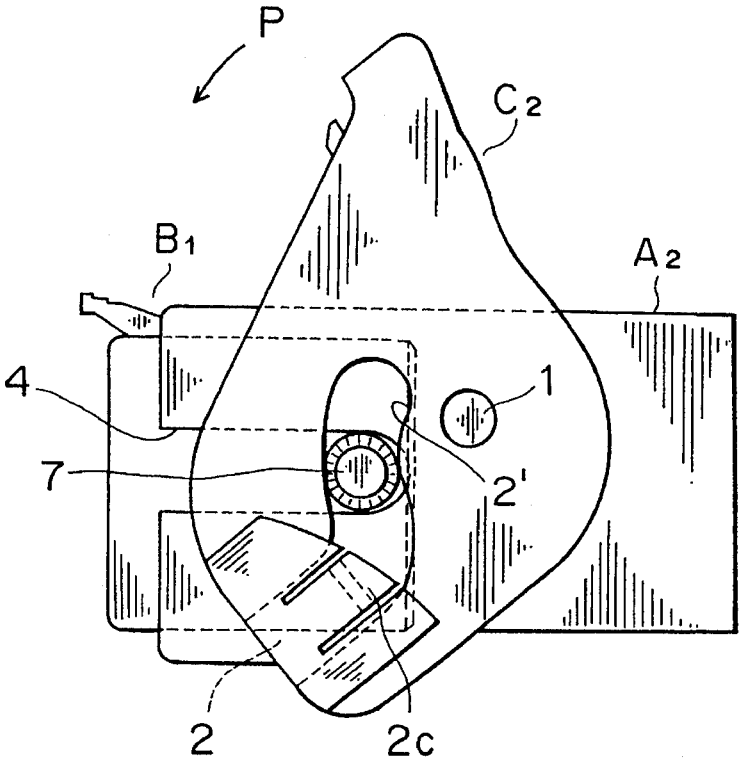
FIG. 8 is a side view showing the rotating process of a lever in the state of FIG. 4.
Figure 9:
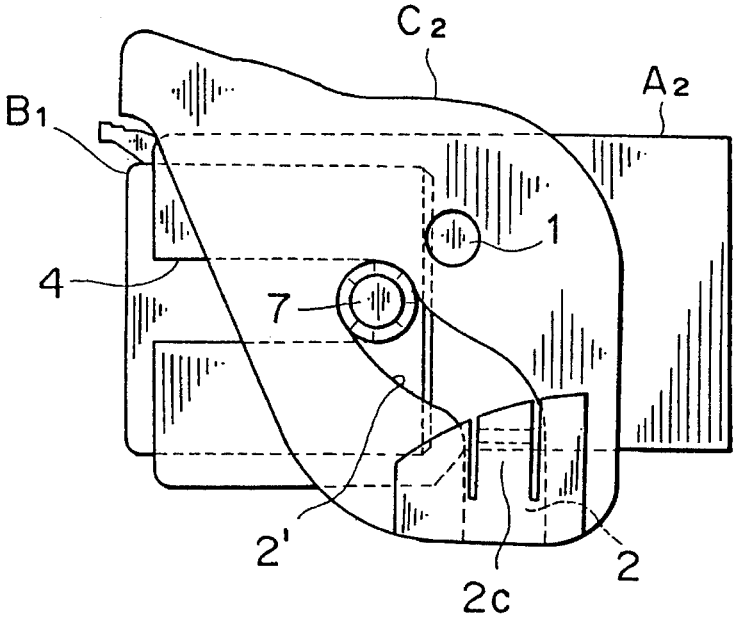
FIG. 9 is a side view of the complete coupled state of the male and female connectors shown in FIG. 3.

When the lever C2 is rotated from the state of FIG. 7 in the direction of an arrow P, the latch pins 7, 7 are moved from the driving cam grooves 2, 2 to the driving cam grooves 2', 2' (FIG. 8). When the lever C2 is further rotated from the state of FIG. 8, the latch pins 7, 7 are moved to the end portions of the driving cam grooves 2', 2'. As a result, the connectors A2 and B1 fall in a complete fitting state (FIG. 9).

Embodiment 3

Figure 12:
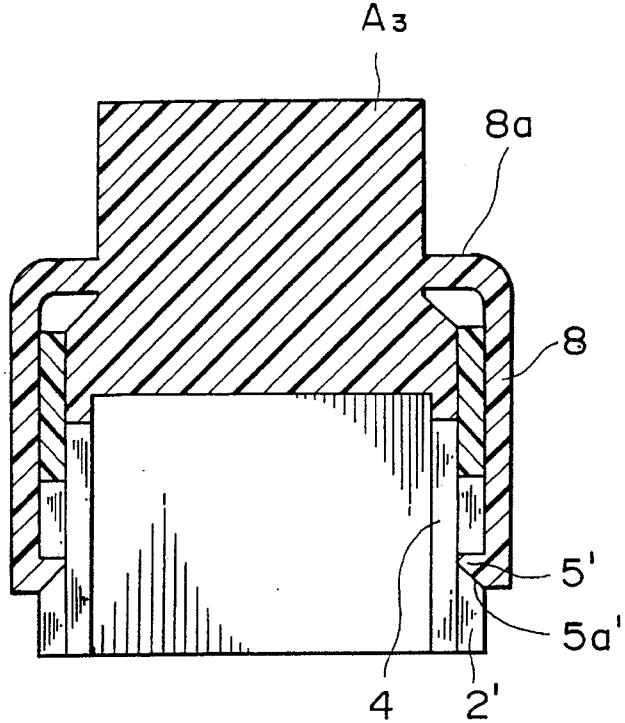
FIG. 12 is a sectional view of the main part in the state in FIG. 10.
Figure 10:
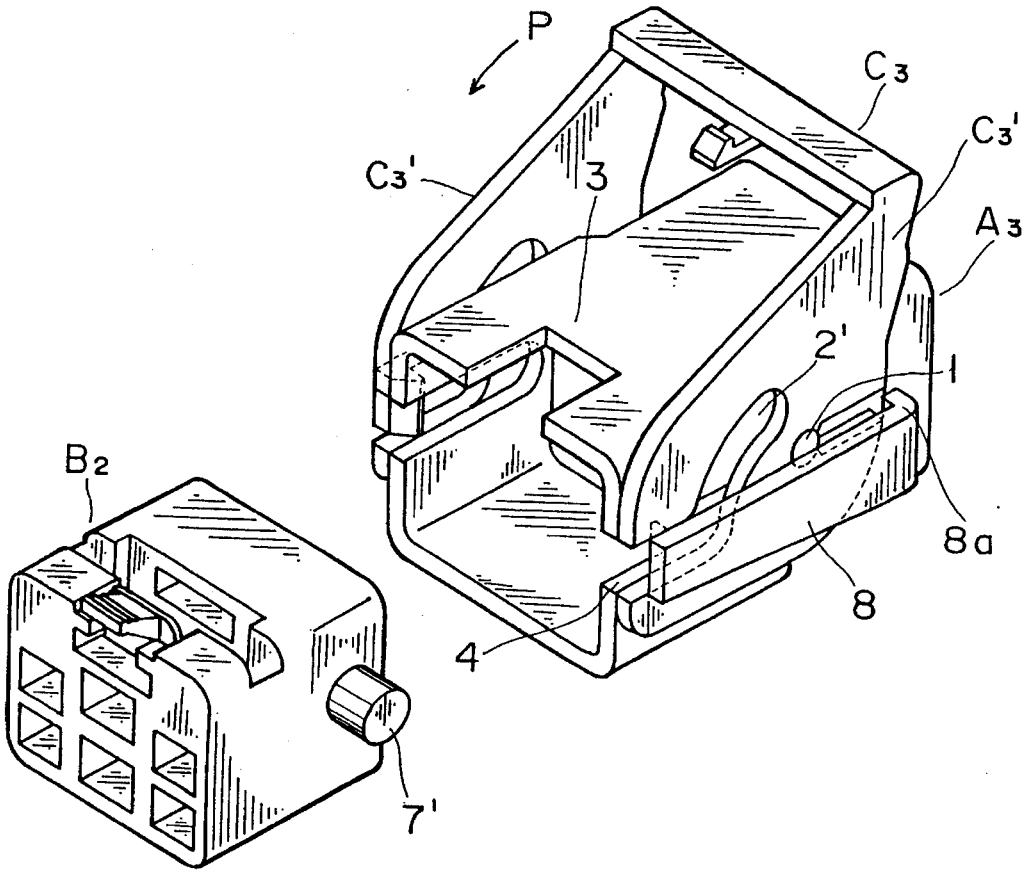
FIG. 10 is a perspective view of the separated state of female and male connectors according to still another embodiment of the present invention.
Figure 14:
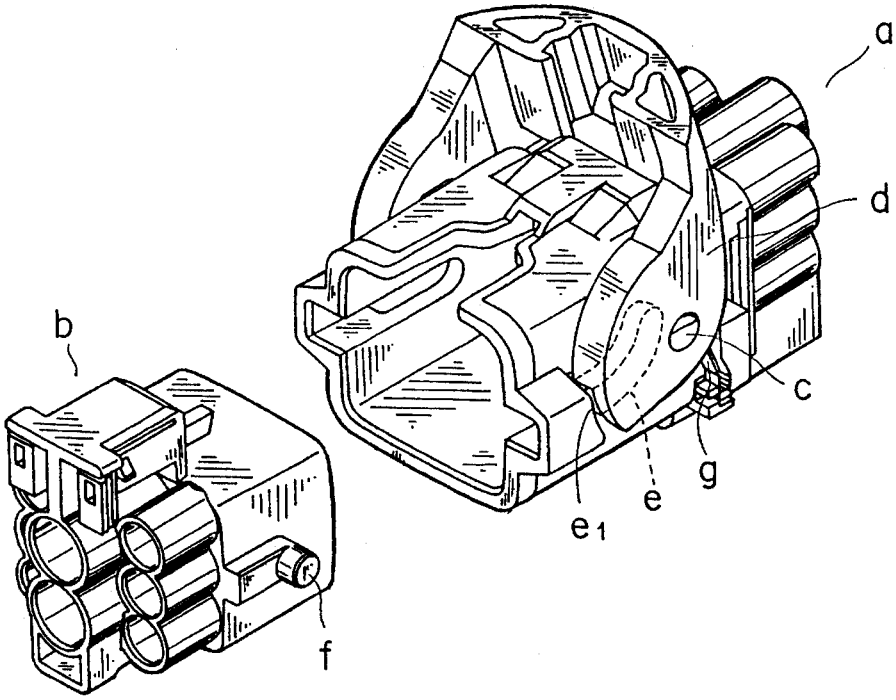
FIG. 14 PRIOR ART
FIG. 14 is a perspective view of the female and male connectors in the prior art.

In the embodiment of FIG. 10, a female connector A3 includes pin-guiding recesses 4, 4 formed in its cover 3. The female connector A3 is provided with a lever C3 provided to be rotatable around its supporting shaft 1. Each of the cam plate portions C3', C3' of the lever C3 has a driving cam groove 2' with no bottom wall. The cover 3 is provided with cantilever resilient arms 8, 8 supported by rear supporting portions 8*a*, 8*a* on the outsides of the cover 3. The resilient arms 8, 8 have initial position holding protrusions 5', 5' protruding on the inner faces of their front end, respectively which are engaged with the driving cam grooves 2', 2' of the lever C3 (FIG. 12).

Figure 11:
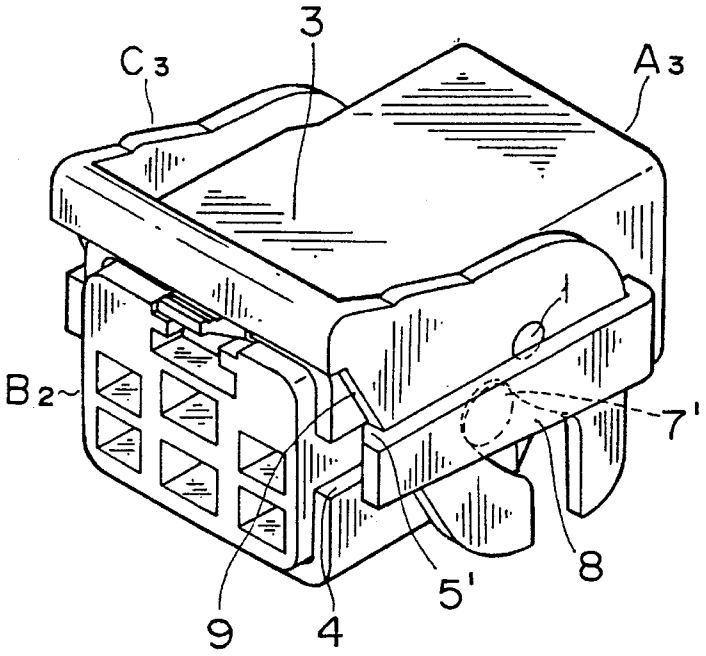
FIG. 11 is a perspective view of the complete coupled state of the connectors shown in FIG. 10.
Figure 13:
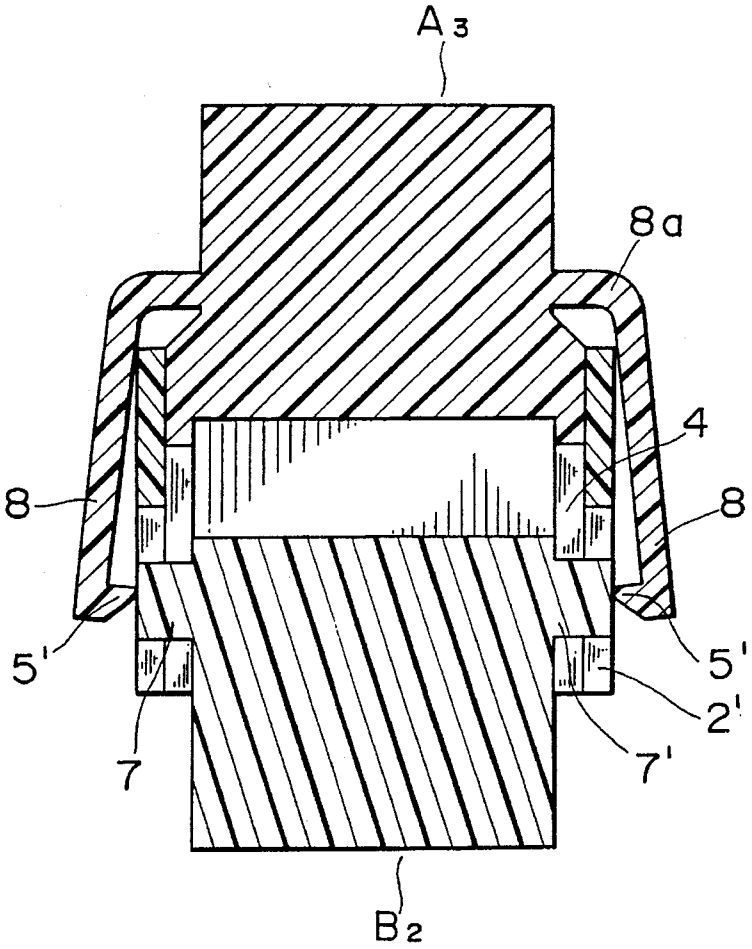
FIG. 13 is a sectional view when the female and male connectors are initially coupled in FIG. 12.

In this state, when the female connector A3 is provisionally coupled to the male connector B2, latch pins 7', 7' extend into the pin guiding recesses 4, 4 and also into driving cam grooves 2', 2'. Then, the latch pins 7', 7' hit on the tapered guiding faces 5*a'*, 5*a'* of the initial position holding protrusions 5', 5' to displace the resilient arms 8, 8 as well as the initial position holding protrusions 5', 5' outwardly. Thus, the initial position holding protrusions 5', 5' are released from the driving cam grooves 2', 2' Accordingly, the lever C3 becomes rotatable in the direction of an arrow P (FIG. 7, FIG. 13). When the lever C3 is rotated so that the female and male connectors fall in a completed fitting state, the initial position holding protrusions 5', 5' are engaged with the end faces 9, 9 of the lever C3 (FIG. 11).

We claim:

1. A lever-coupled connector comprising:

a male connector having a body and latch pins extending laterally therefrom;

a female connector having walls containing pin-guiding recesses into open ends of which the latch pins are to be received;

a lever having cam plates disposed on opposite sides of said female connector adjacent the walls thereof and being rotatably attached thereto, said cam plates having driving cam grooves containing bottom walls defining open ends for receiving said latch pins when said lever is in its initial position wherein said open ends of said bottom walls align with said open ends of said pin-guiding recesses, said lever carrying resilient pieces formed on the bottom walls of said driving cam grooves and having initial position holding protrusions operative to extend into and engage the pin-guiding recesses of said female connector in the initial position to align the open ends of said bottom walls and said pin-guiding recesses and to prevent said lever from being rotated, said latch pins having a lateral extent sufficient when said male connector is inserted into the female connector to enter said aligned open ends of said bottom walls and said pin-guiding recesses to engage said protrusions on said resilient pieces for urging them out of said pin-guiding recesses to release said protrusions to permit said lever to rotate.

2. A lever-coupled connector comprising:

a male connector having a body and latch pins extending laterally therefrom;

a female connector having walls containing pin-guiding recesses, into open ends of which said latch pins are to be received;

a lever having cam plates disposed on opposite sides of said female connector adjacent the walls thereof and being rotatably attached thereto, said cam plates having driving cam grooves with open ends for receiving said latch pins when said lever is in its initial position wherein said open ends of said pin-guiding recesses align with said open ends of said driving cam grooves, cantilever arms each being attached at one end to the walls of said female connector and each being provided at their free end with an initial position holding protrusion operative to extend into and to engage the pin-guiding recesses of said female connector to align the open ends of said pin-guiding recesses and said driving cam grooves and to prevent said lever from being rotated, said latch pins having a lateral extent sufficient when said male connector is inserted into the female connector to enter said aligned open ends of said pin-guiding recesses and said driving cam grooves to release said protrusions to permit said lever to rotate.

3. The lever-coupled connector according to claim 1, wherein each of said latch pins has a tapered face in its tip.

4. The lever-coupled connector according to claim 2, wherein each of said latch pins has a tapered face in its tip.

5. The lever-coupled connector according to claim 2, wherein each of said protrusions has a tapered surface cooperating with said latch pins for moving said arms out of engagement with the driving cam grooves.

* * * * *